US010883520B2

(12) United States Patent
Li et al.

(10) Patent No.: US 10,883,520 B2
(45) Date of Patent: Jan. 5, 2021

(54) FAN DEVICE, MOTOR AND LIQUID PUMP

(71) Applicant: Johnson Electric S.A., Murten (CH)

(72) Inventors: Min Li, Shenzhen (CN); Jin Jin Wu, Shen Zhen (CN); Kok Ang Chong, Hong Kong (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 637 days.

(21) Appl. No.: 15/452,273

(22) Filed: Mar. 7, 2017

(65) Prior Publication Data

US 2017/0254343 A1 Sep. 7, 2017

(30) Foreign Application Priority Data

Mar. 7, 2016 (CN) ..... 2016 2 0173309 U

(51) Int. Cl.

| | |
|---|---|
| ***F04D 29/62*** | (2006.01) |
| ***F04D 29/26*** | (2006.01) |
| ***F04D 29/02*** | (2006.01) |
| ***F04D 17/08*** | (2006.01) |
| ***F04D 25/06*** | (2006.01) |
| ***F04D 25/16*** | (2006.01) |
| ***F04D 29/053*** | (2006.01) |

(Continued)

(52) U.S. Cl.

CPC ..... *F04D 29/626* (2013.01); *F04D 17/08* (2013.01); *F04D 25/06* (2013.01); *F04D 25/16* (2013.01); *F04D 29/023* (2013.01); *F04D 29/053* (2013.01); *F04D 29/263* (2013.01); *F04D 29/281* (2013.01); *F04D 29/5806* (2013.01); *F04D 29/588* (2013.01); *F05D 2300/50211* (2013.01)

(58) Field of Classification Search

CPC ..... F04D 29/626; F04D 25/16; F16D 1/06; B21D 41/021; Y10T 29/4992

USPC ..... 416/204 R, 205, 220 R, 244 R; 29/513, 29/517, 509

See application file for complete search history.

(56) References Cited

U.S. PATENT DOCUMENTS 633,376 A * 9/1899 Davies ..... F04D 29/263 416/204 R
2,599,730 A * 6/1952 Sutton ..... F16D 3/78 464/92

(Continued)

FOREIGN PATENT DOCUMENTS

EP 3156657 A1 * 4/2017 ..... F04D 25/0613
FR 2741842 A1 * 6/1997 ..... B60H 1/00457
GB 2002182 A * 2/1979 ..... A45D 20/10

OTHER PUBLICATIONS

Davis, J. R. (2001). Alloying: understanding the basics. Materials Park, OH: ASM International. doi: 10.1361/autb2001; Aluminum and Aluminum Alloys, p. 351-416 (Year: 2001).*

(Continued)

*Primary Examiner* — David E Sosnowski
*Assistant Examiner* — Hakeem M Abdellaoui
(74) *Attorney, Agent, or Firm* — Muncy, Geissler, Olds & Lowe, P C.

(57) ABSTRACT

A fan device includes a driving device, a fan wheel, and a locking fastener. The driving device includes a shaft. The fan wheel defines a shaft hole to receive the shaft. The locking fastener has a thermal expansion coefficient same as a thermal expansion coefficient of the shaft.

15 Claims, 7 Drawing Sheets

(51) Int. Cl.
*F04D 29/28* (2006.01)
*F04D 29/58* (2006.01)

(56) References Cited

U.S. PATENT DOCUMENTS 2,900,202 A * 8/1959 Thompson ..... F04D 29/329 403/199
3,084,963 A * 4/1963 Beehler ..... F04D 29/263 403/226
3,319,324 A * 5/1967 Keller ..... H05K 13/04 29/513
4,652,169 A * 3/1987 Matthews ..... B21D 39/06 403/261
4,831,916 A * 5/1989 Leigh-Monstevens ..... B60T 11/16 403/135
5,163,224 A * 11/1992 Wells ..... F16F 9/3214 29/513
5,231,748 A * 8/1993 Knudson ..... B21J 15/04 227/15
10,267,335 B1 * 4/2019 Freakes ..... F04D 29/624
10,415,583 B2 * 9/2019 Yamamoto ..... F04D 29/023
2002/0176780 A1 * 11/2002 Crevel ..... F04D 29/263 416/204 R
2005/0191178 A1 * 9/2005 Watkins ..... F04D 29/20 415/216.1
2009/0041601 A1 * 2/2009 Sun ..... F04D 29/626 417/423.12
2010/0158664 A1 * 6/2010 Ko ..... F04D 17/04 415/53.1
2012/0062079 A1 * 3/2012 Horng ..... F04D 29/263 310/75 R
2014/0359969 A1 * 12/2014 Kim ..... H02K 1/278 15/412
2016/0290344 A1 * 10/2016 Lewis ..... F04D 29/023
2017/0107994 A1 * 4/2017 Kosaka ..... F04D 25/0613

OTHER PUBLICATIONS

Aalco—Ferrous. (Jun. 27, 2019). Aluminium—Specifications, Properties, Classifications and Classes. Retrieved Oct. 15, 2019, from https://www.azom.com/article.aspx?ArticleID=2863. (Year: 2019).*
Agilent Technologies. (2002). Material Expansion Coefficients. In Laser and Optics User's Manual(pp. 17-1-17-12). (Year: 2002).*

* cited by examiner

FAN DEVICE, MOTOR AND LIQUID PUMP

CROSS REFERENCE TO RELATED APPLICATIONS

This non-provisional patent application claims priority under 35 U.S.C. § 119(a) from Patent Application No. 201620173309.5 filed in The People's Republic of China on Mar. 7, 2016.

FIELD OF THE INVENTION

The present disclosure relates to the field of a fan device, and particularly relates to a motor and a liquid pump thereof.

BACKGROUND OF THE INVENTION

A motor can generate a lot of heat, when the motor is operating. For cooling the motor, a fan device is fixed in one end of a shaft of the motor and the motor drives the fan device to rotate to generate air flow to cool the motor.

The fan device is generally made of plastic and fixed to the shaft in an interference fit way. When the working ambient temperature of the motor is high, it is easy to cause the fan device to fall off, because the expansion coefficient of the plastic is different from that of the shaft.

Below, embodiments of the present invention will be described in detail with reference to the accompanying drawings.

DETAILED DESCRIPTION OF THE PREFERRED EMBODIMENTS

The technical solutions of the embodiments of the present invention will be clearly and completely described as follows with reference to the accompanying drawings. Apparently, the embodiments as described below are merely part of, rather than all, embodiments of the present invention. Based on the embodiments of the present disclosure, any other embodiment obtained by a person skilled in the art without paying any creative effort shall fall within the protection scope of the present invention.

It is noted that, when a component is described to be "fixed" to another component, it can be directly fixed to the another component or there may be an intermediate component, i.e. indirectly fixed to the another component through a third component. When a component is described to be "connected" to another component, it can be directly connected to the another component or there may be an intermediate component. When a component is described to be "disposed" on another component, it can be directly disposed on the another component or there may be an intermediate component.

Unless otherwise specified, all technical and scientific terms have the ordinary meaning as understood by people skilled in the art. The terms used in this disclosure are illustrative rather than limiting. The term "and/or" as used in this disclosure means that each and every combination of one or more associated items listed are included.

Figure 1:
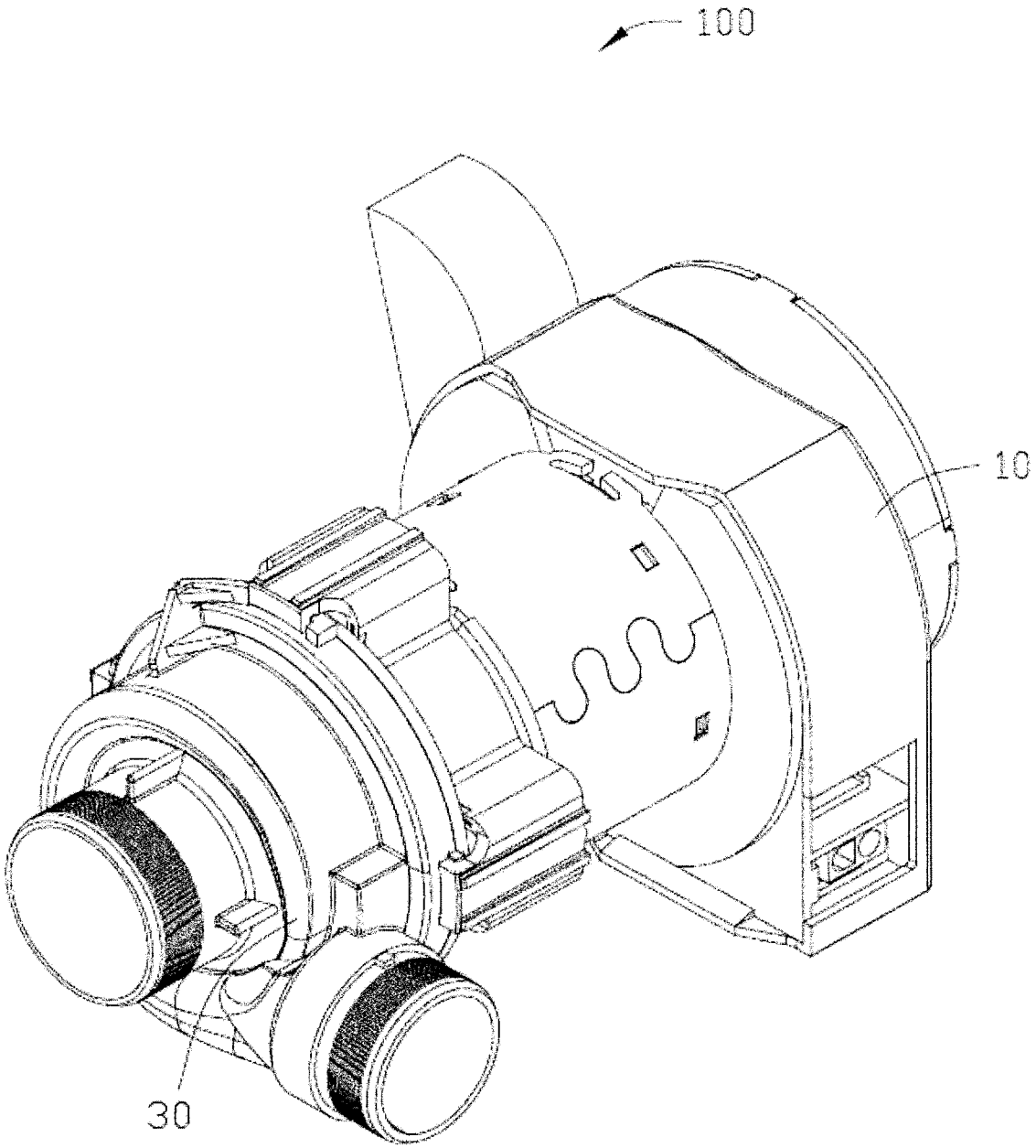
FIG. 1 shows a stereoscopic schematic view of a liquid pump in one embodiment of the present disclosure.
Figure 2:
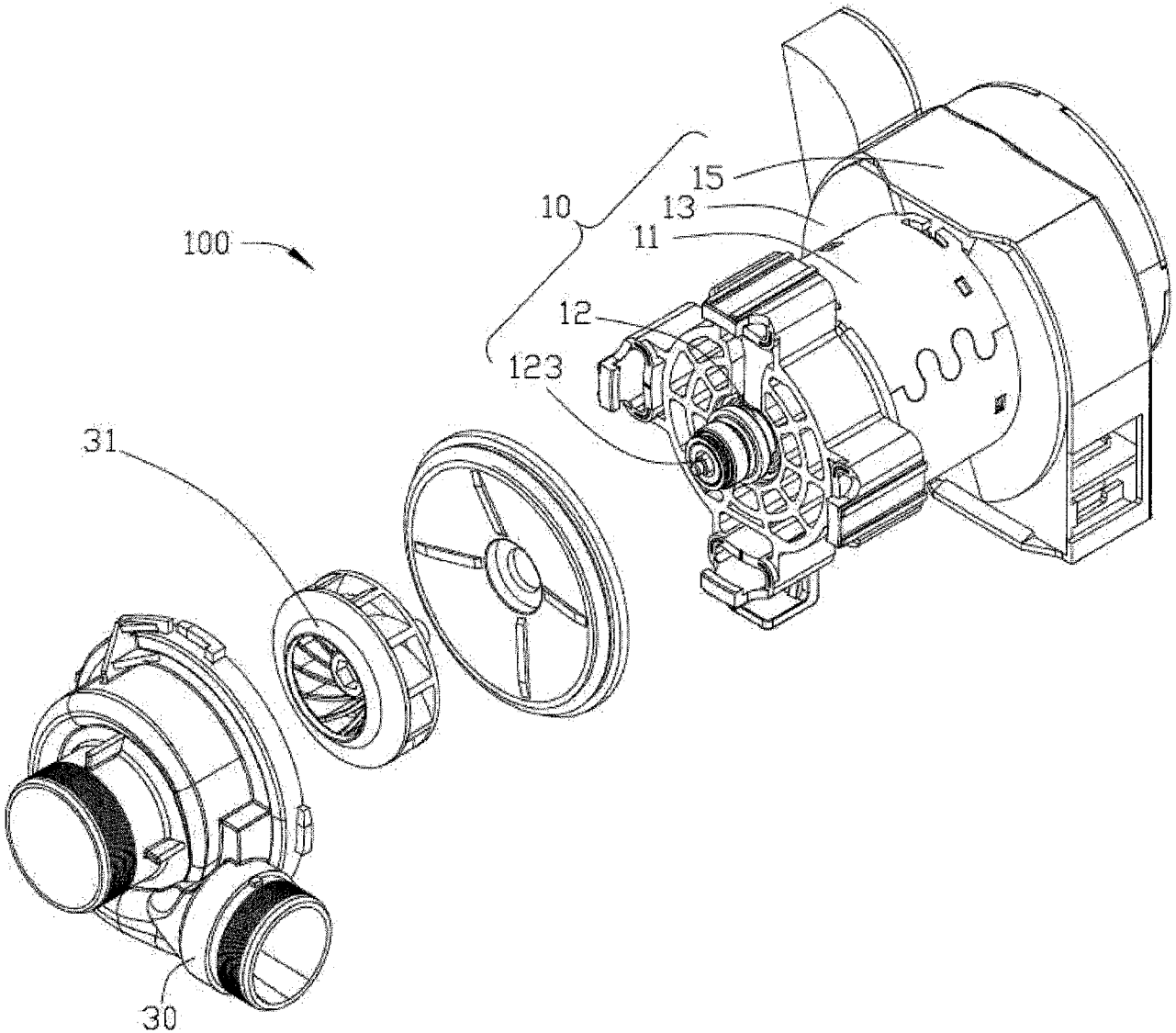
FIG. 2 shows an exploded view of one portion of the liquid pump shown in FIG. 1.
Figure 3:
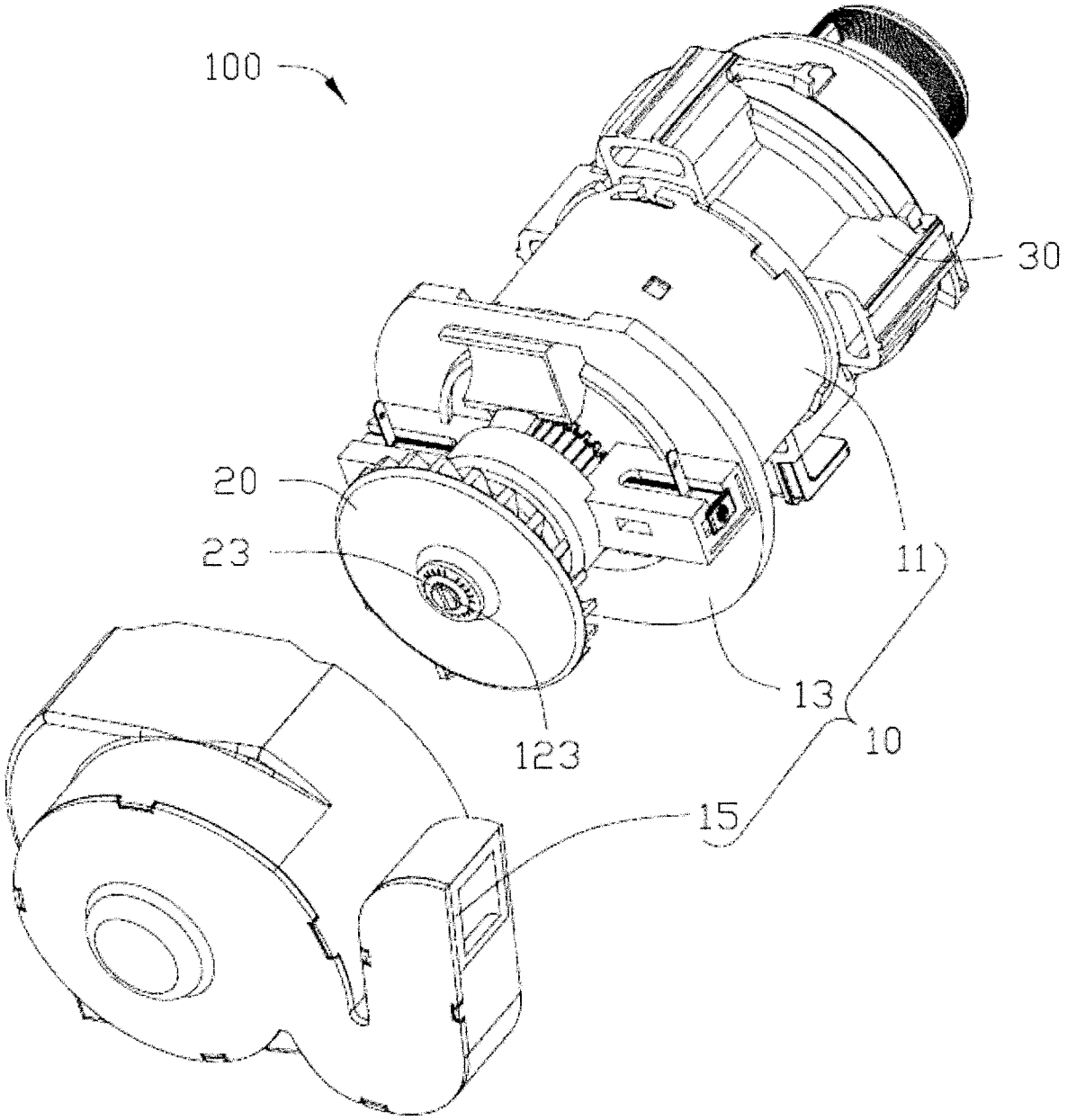
FIG. 3 is an exploded view of the other portion of the liquid pump shown in FIG. 1.

Referring to FIGS. 1-3, one embodiment of the present disclosure provides a liquid pump 100, wherein the liquid pump 100 is used for water circulation and discharge in a dishwasher, a washing machine or the like. The liquid pump 100 includes at least one motor 10 and a pump 30, wherein the motor 10 is connected with the pump 30, and an impeller 31 of the pump 30 is driven by the motor 10 to generate a vacuum suction in the pump 30, so as to realize liquid circulation and discharge.

The motor 10 includes a housing 11, a stator (not marked) and a rotor 12 provided in the housing 11, an end cap 13 used for fixing the rotor 12 and provided at one end of the housing 11, a cover 15 and a fan device 20 (as shown in FIG. 3). The rotor 12 includes a shaft 123, and the fan device 20 is mounted at one end of the shaft 123. The cover 15 is connected to the end cap 13. The shaft 123 drives the fan device 20 to rotate to generate an air flow, so as to cool the motor 10 and the pump 30.

In the embodiment, the motor 10 includes the fan device 20. In another embodiment, the fan device 20 can also include a driving device that drives the fan device 20; the driving device includes a shaft and can be a motor or other power sources.

Figure 4:
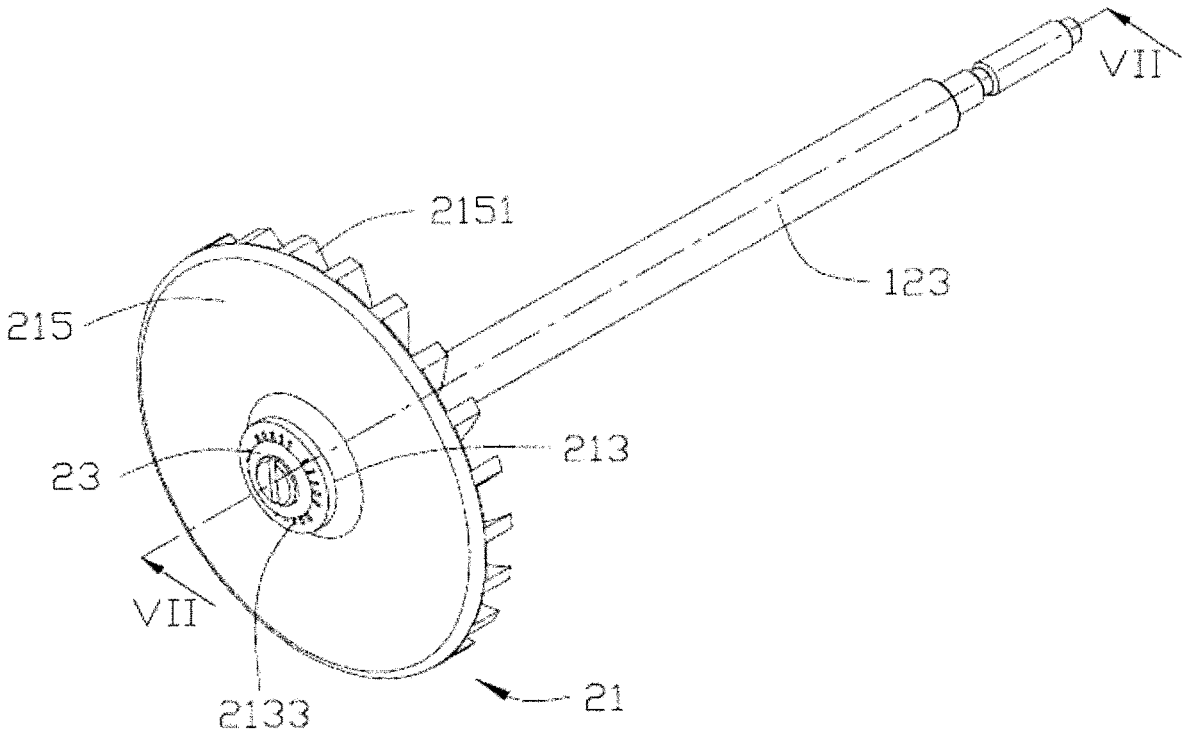
FIG. 4 shows a stereoscopic schematic view of the partial structure of a fan device shown in FIG. 1.
Figure 5:
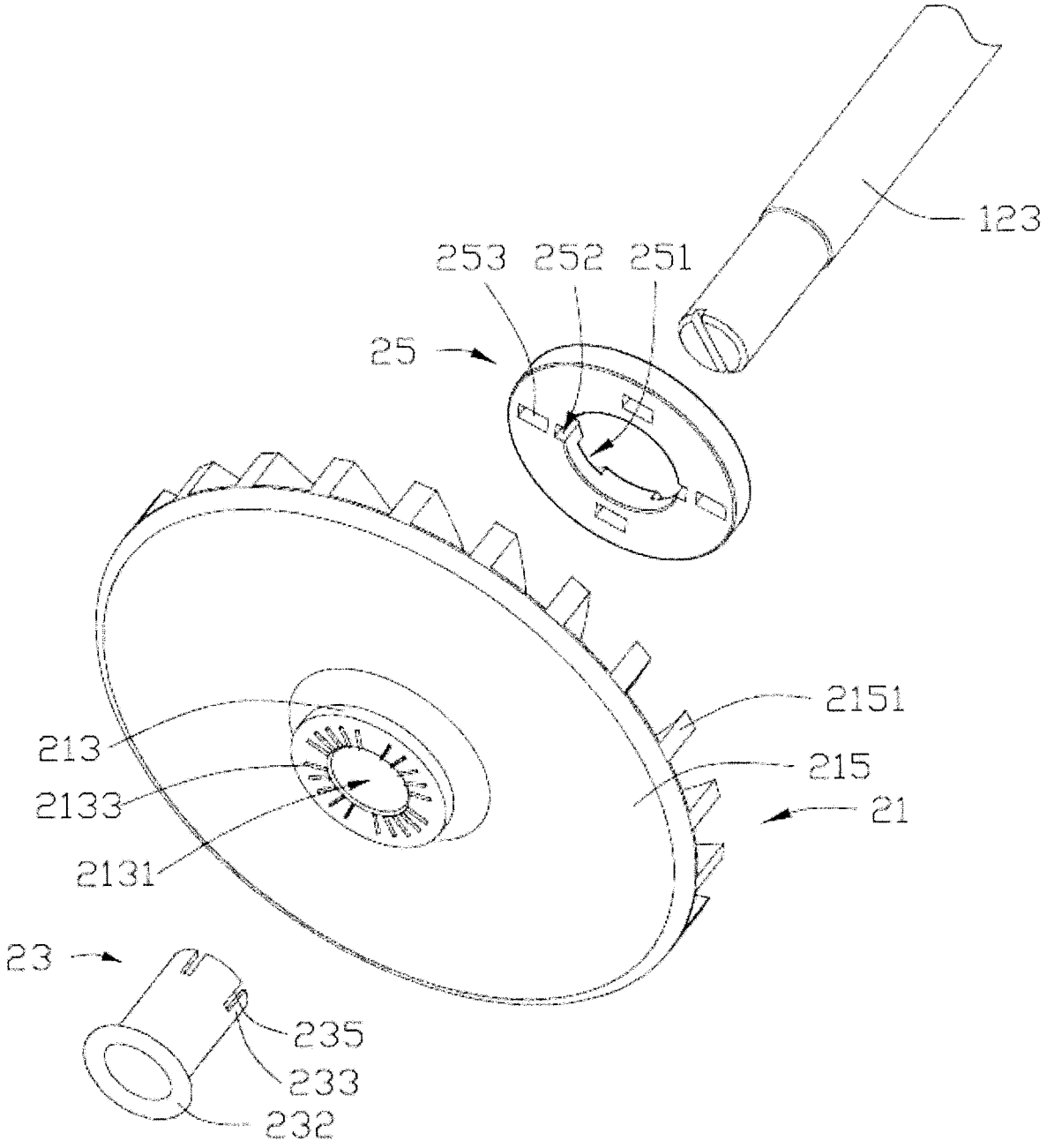
FIG. 5 shows a partially exploded view of the partial structure of the fan device shown in FIG. 4.

Referring to FIGS. 4-5, the fan device 20 includes a fan wheel 21, a locking fastener 23 and a retaining ring 25. The fan wheel 21 is sleeved onto the locking fastener 23 and the locking fastener 23 is sleeved onto the shaft 123. The retaining ring 25 is used for preventing a magnetic flux leakage, so as to improve efficiency of the motor 10. In other embodiments, the retaining ring 25 can be omitted. The locking fastener 23, the retaining ring 25 and the shaft 123 are made from materials having similar expansion coefficients. Preferably, the locking fastener 23, the retaining ring 25 and the shaft 123 have a same expansion coefficient.

The fan wheel 21 includes a fixing member 213 and an outer ring part 215. In the embodiment, the fixing member 213 is generally of a circular shape, while the outer ring part 215 is generally of a disk shape. The fixing member 213 is convexly formed from the outer ring part 215 along an axis direction. The fixing member 213 is disposed at an axis position of the outer ring part 215. The fan wheel 21 is made of materials like plastics and rubber, and the fixing member 213 and the outer ring part 215 are integrally formed through injection molding or pouring.

The fixing member 213 defines a shaft hole 2131 along the axis direction, and the locking fastener 23 and the shaft 123 can penetrate through the shaft hole 2131. An end face at one end of the fixing member 213 protruding out of the outer ring part 215 is circularly provided with a plurality of ribs 2133, and the ribs 2133 resist against the locking fastener 23 to increase the friction between the fixing member 213 and the locking fastener 23.

Figure 6:
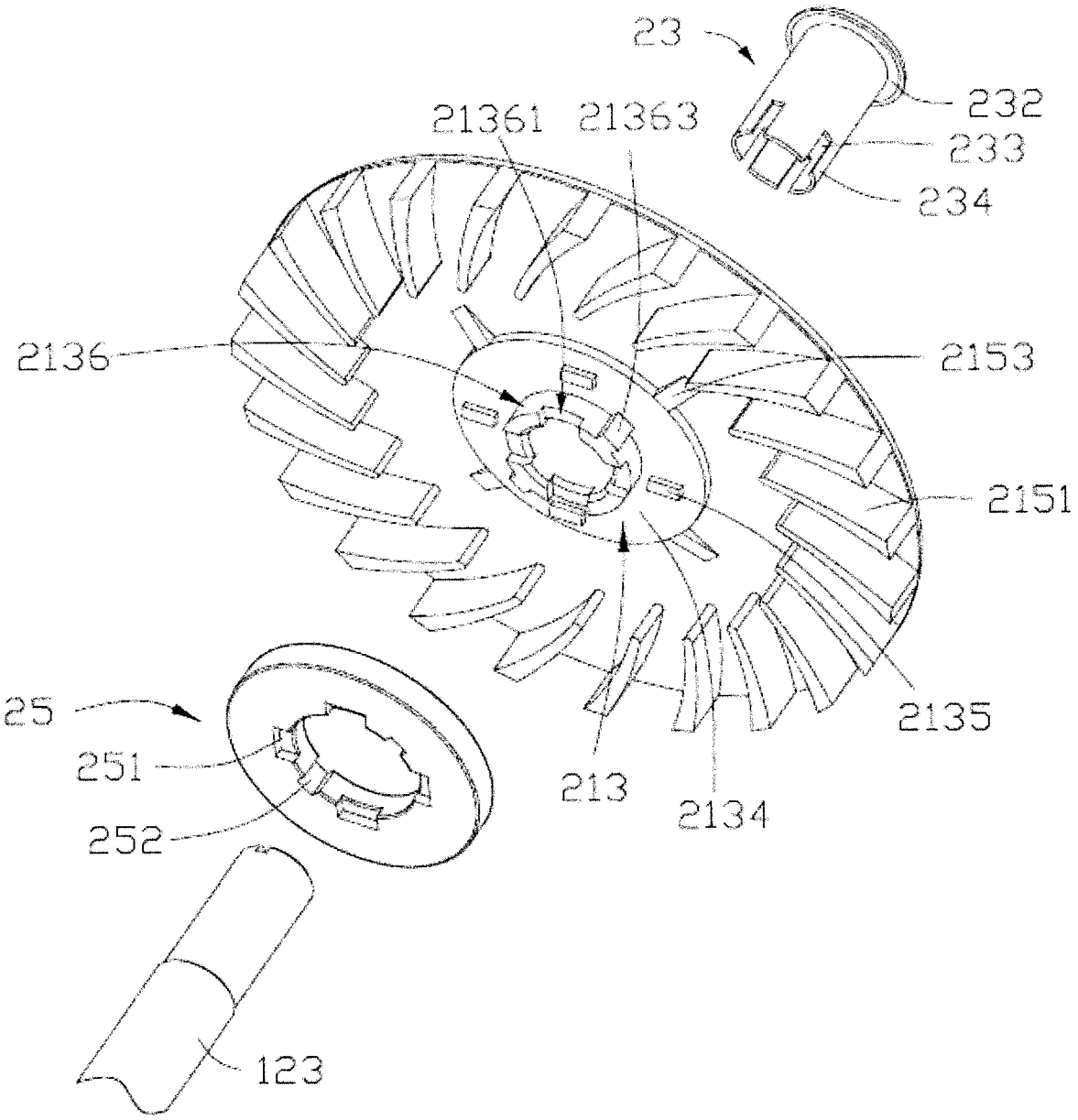
FIG. 6 shows an exploded view of the partial structure in another direction of the fan device shown in FIG. 4.

Referring to FIG. 6, in the embodiment, the other end of the fixing member 213 includes a step portion 2134 and a clamping portion 2136. The step portion 2134 and the clamping portion 2136 are two cylinders with different diameters, wherein a diameter of the step portion 2134 is greater than that of the clamping portion 2136. The step portion 2134 is formed by extending along the outer ring part 215 away from the ribs 2133, and the clamping portion 2136 is provided at one side of the step portion 2134 against the outer ring part 215. The step portion 2134 and the clamping portion 2136 are coaxially disposed.

A plurality of projection portions 2135 are uniformly and circularly arranged at one side of the step portion 2134 provided with the clamping portion 2136 for clamping the retaining ring 25 at intervals.

A plurality of clamping grooves 21361 are defined at an end wall at one end of the clamping portion 2136 against the step portion 2134 along the axis direction of the clamping portion 2136, and the clamping grooves 21361 are uniformly provided at intervals to clamp the locking fastener 23. A peripheral wall of the clamping portion 2136 is also provided with a plurality of clamping blocks 21363 in a radial direction, and the clamping blocks 21363 are used for clamping the retaining ring 25. The clamping grooves 21361 and the clamping blocks 21363 are provided at intervals, the structural strength of the clamping portion 2136 can be improved.

The outer ring part 215 includes a plurality of blades 2151 and a plurality of reinforcing ribs 2153. The plurality of blades 2151 are circularly provided onto the outer ring part 215 at intervals. In the embodiment, each blade 2151 is of an arc shape, one end of which extends to an edge of the outer ring part 215. The plurality of reinforcing ribs 2153 are disposed in a connection portion of the outer ring part 215 and the step portion 2134 at intervals, in order to enhance the structural strength of the whole fan wheel 21.

The locking fastener 23 is used for fixing the fan wheel 21 to the shaft 123. In the embodiment, the locking fastener 23 is generally of a hollow cylindrical nail body and is mounted to an inner wall of the shaft hole and is sleeved at one end of the shaft 123. One end of the locking fastener 23 is provided with an annular nail head 232; the other end of the locking fastener 23 is provided with an axial gap 233 to divide the other end of the nail body into a plurality of leaflets 234. An diameter of the nail head 232 is greater than an inner diameter of the fixing member 213. The nail head 232 can resist against the ribs 2133.

Referring to FIG. 5 and FIG. 6, the retaining ring 25 is of a hollow cyclic structure, one end face of which is circularly provided with a plurality of first grooves 251, and each of first groove 251 is communicated with a hollow part (not marked) of the retaining ring 25. An inner arc surface of the retaining ring 25 is uniformly and circularly provided with a plurality of second grooves 252, and each clamping block 21363 is clamped into one of the second grooves 252. The other end face of the retaining ring 25 is provided with a plurality of retaining grooves 253 at intervals, and each projection portion 2135 is clamped into one of the retaining grooves 253.

Figure 7:
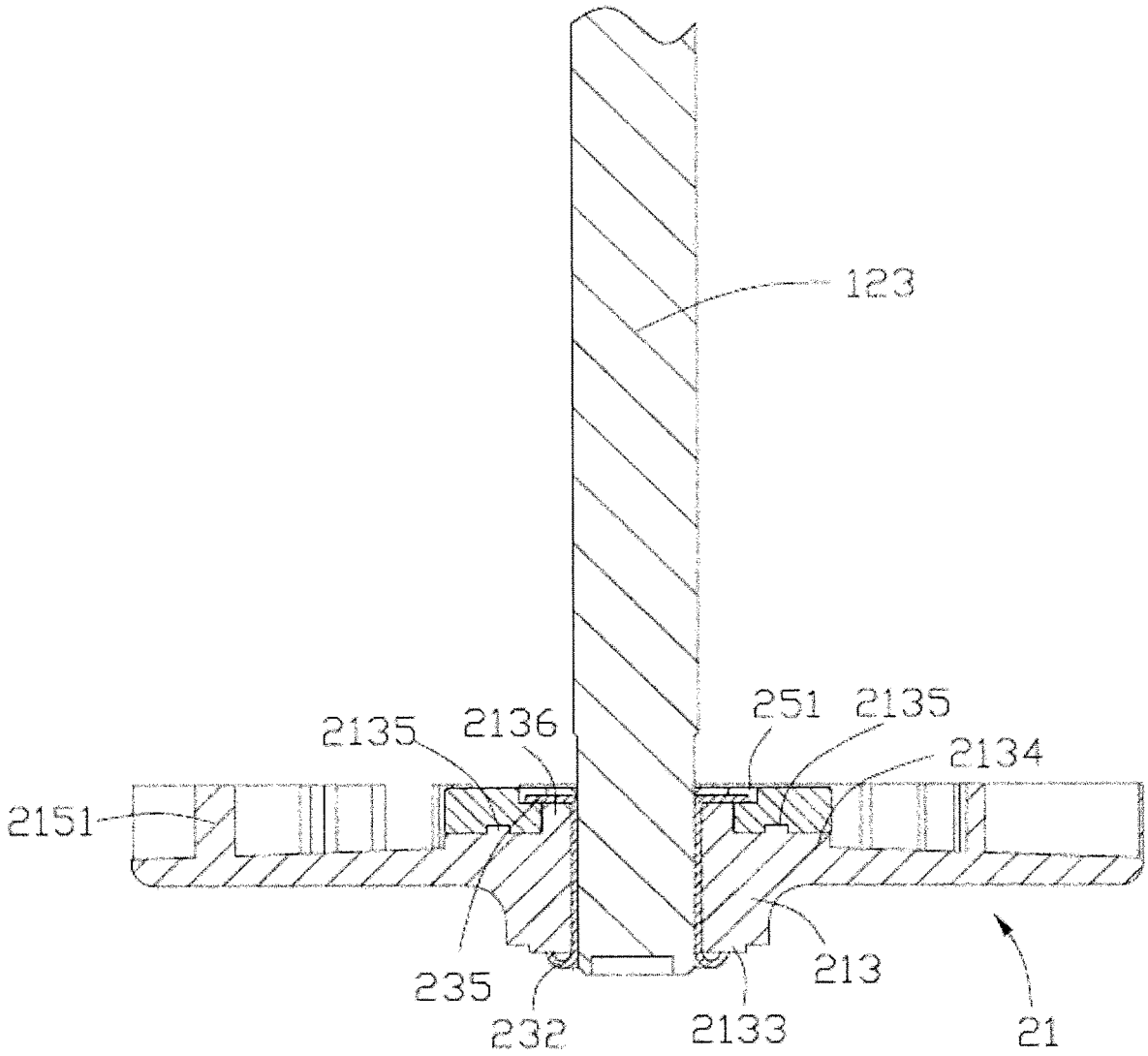
FIG. 7 shows a section view of the partial structure of the fan device shown in FIG. 4 along a VII-VII direction.

Referring to FIG. 7, the process of assembling the fan device 20 is as follows: the retaining ring 25 is sleeved onto the fixing member 213, each clamping block 21363 is clamped into one corresponding second groove 252, and each projection portion 2135 is clamped into one corresponding clamping groove 253. One end of the locking fastener 23 away from the nail head 232 is inserted into the fixing member 213 from one side of the fixing member 213 provided with a plurality of ribs 2133, so that the nail head 232 is pressed against the plurality of ribs 2133. The leaflet 234 at one end of the locking fastener 23 is hammered or pressurized to flange the plurality of leaflet 234 against an axis direction of the locking fastener 23, so as to form a plurality of bent portions 235; each bent portion 235 extends along a radial direction of the locking fastener 23 to clamp each bent portion 235 to the corresponding clamping groove 21361; an end portion of each bent portion 235 is further clamped into the corresponding first groove 251 over the clamping groove 21361, to limit axial displacement between the retaining ring 25 and the fixing member 213, and the retaining ring 25 is fixedly provided to the fixing member 213 in an interference fit way.

The locking faster 23 is sleeved to one end of the shaft 123 to allow the fan wheel 21 to rotate along with the shaft 123. In the embodiment, the locking fastener 23 is made of a metal material, and is fixedly provided at one end of the shaft 123 in an interference fit way.

It can be understood that, in other embodiments provided by the present disclosure, the projection portion 2135 can be directly and circularly provided onto the outer ring part 215 along the axis of the outer ring part 215 at intervals, and the step portion 2134 can be omitted.

It can be understood that, when the step portion 2134 is omitted, the plurality of reinforcing ribs 2153 are disposed at a connection portion of the outer ring part 215 and the clamping portion 2136 at intervals.

It can be understood that positions of each clamping block 21363 and each second groove 252 can be interchanged, i.e. the plurality of clamping blocks 21363 are disposed in the inner arc surface of the retaining ring 25 at intervals, while the plurality of second grooves 252 are disposed in the peripheral wall of the clamping portion 2136 at intervals. Each clamping block 21363 is clamped in the corresponding second groove 252.

It can be understood that positions of each projection portion 2135 and each clamping groove 253 can be interchanged, i.e. the plurality of projection portions 2135 are provided at one side of the retaining ring 25 against one side of the first grooves 251 at intervals, and the plurality of clamping grooves 253 are provided at one side of the step portion 2134 close to the clamping portion 2136 at intervals. Each projection portion 2136 is clamped in the corresponding second groove 253.

The fan device 20 comprises the locking fastener 23 and the retaining ring 25 which are made from a material with an expansion coefficient approximate to the shaft; the nail heads 232 at both ends of the locking fastener 23 and a plurality of bent portions 235 are fixed in the fan wheel 21, and then the fan wheel 21 with the locking fastener 23 is fixed on one end of the shaft 123, thus the fan wheel 21 will not be affected when the shaft 123 is heated, i.e. the fan device 20 will not be separated from the shaft 123 after being expanded by heating. And moreover, the fan wheel 21 is fixedly clamped to the shaft 123 by the locking fastener 12, the complicated processes of traditional knurling on the shaft 123 is omitted. In summary, the fan device 20 is simple to assemble and can operate with high efficiency.

Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated herein should not be interpreted as limits to the present invention, and the scope of the invention is to be determined by reference to the claims that follow.

The invention claimed is:

1. A fan device, comprising:

a driving device having a shaft;

a fan wheel defining a shaft hole to receive the shaft;

a locking fastener to lock the fan wheel on the shaft; and wherein a thermal expansion coefficient of the locking fastener is the same as a thermal expansion coefficient of the shaft, wherein the fan wheel further comprises a fixing member and an outer ring part, the fixing member is disposed at an axis position of the outer ring part and is convexly formed from the outer ring part, and the shaft hole is defined in the fixing member along an axis of the outer ring part, the locking fastener penetrates through the shaft hole and locks the fixing member to the shaft; wherein the locking fastener is of a hollow cylindrical nail body, a nail head is arranged in one end of the locking fastener and a plurality of leaflets divided by a gap arranged in the other end of the locking fastener, and the nail head resists against one end of the fixing member; and wherein a plurality of clamping grooves are formed in an end wall at one end of the fixing member, the other end of the locking fastener is provided with bent portions, and the other end of the fixing member away from the clamping grooves resists against one corresponding nail head and the bent portions are clamped in the clamping grooves.

2. The fan device according to claim 1, wherein the fixing member comprises a clamping portion and a step portion; and the plurality of clamping grooves are formed in a peripheral wall of the clamping portion, one end of the fixing member resists the nail head and the bent portions are clamped in the clamping grooves.

3. The fan device according to claim 2, wherein the peripheral wall of the clamping portion is provided with a plurality of clamping blocks in a radial direction, and the clamping blocks and the clamping grooves are provided disposed at intervals.

4. The fan device according to claim 3, further comprising a retaining ring, wherein one end face of the retaining ring circularly defines a plurality of first grooves, and the a tail end of each bent portion penetrates through the corresponding clamping groove and then is clamped in the first groove.

5. The fan device according to claim 4, wherein a plurality of second grooves are uniformly and circularly defined in an inner arc surface of the retaining ring is uniformly and circularly provided with a plurality of second grooves, and each clamping block is clamped into one of the second grooves.

6. The fan device according to claim 3, wherein one side of the step portion is provided with a plurality of projection portions are disposed in one side of the step portion, a plurality of clamping grooves are disposed in one side of the retaining ring is provided with a plurality of clamping grooves, and each projection portion is clamped in one of the clamping grooves.

7. The fan device according to claim 1, wherein a plurality of ribs are circularly arranged at one end face of the fixing member against the bent portions is circularly provided with a plurality of ribs at intervals, and the nail heads are pressed against the ribs.

8. The motor fan device according to claim 2, wherein a plurality of blades are disposed at one side of the outer ring part, close to the clamping portion, is circularly provided with a plurality of blades at intervals.

9. A motor, comprising:

a housing;

a stator disposed in the housing;

a rotor disposed in the housing;

an end cap covered at one end of the housing; and a fan device fixed by a shaft of the rotor, wherein the fan device comprises a fan wheel defining a shaft hole to receive the shaft; and a locking fastener to lock the fan wheel on the shaft; wherein a thermal expansion coefficient of the locking fastener is the same as a thermal expansion coefficient of the shaft, the fan wheel further comprises a fixing member and an outer ring part, the fixing member is disposed at an axis position of the outer ring part and is convexly formed from the outer ring part, and the shaft hole penetrates through the fixing member along an axis; a plurality of clamping grooves are formed in an end wall at one end of the fixing member, the locking fastener is of a hollow cylindrical nail body, a nail head is arranged in one end of the locking fastener, the other end of the locking fastener is provided with bent portions, the other end of the fixing member away from the clamping grooves resists against the nail head and the bent portions are clamped in the clamping grooves.

10. The motor according to claim 9, wherein the fixing member comprises a clamping portion and a step portion; and the plurality of clamping grooves are formed in a peripheral wall of the clamping portion, one end of the fixing member resists the nail head and the bent portions are clamped in the clamping grooves.

11. The motor according to claim 10, wherein the peripheral wall of the clamping portion is provided with a plurality of clamping blocks in a radial direction, and the clamping blocks and the clamping grooves are disposed at intervals.

12. The motor according to claim 11, wherein the fan device further comprises a retaining ring, one end face of is the retaining ring circularly defines a plurality of first grooves, and a tail end of each bent portion penetrates through the corresponding clamping groove and is clamped in the first groove.

13. The motor according to claim 12, wherein a plurality of second grooves are uniformly and circularly defined in an inner arc surface of the retaining ring, and each clamping block is clamped into one of the second grooves.

14. A liquid pump, comprising:

a pump; and the motor of claim 9 driving the pump to operate.

15. A fan device, comprising:

a driving device having a shaft;

a fan wheel defining a shaft hole to receive the shaft;

a locking fastener to lock the fan wheel on the shaft; and wherein the locking fastener has a thermal expansion coefficient same as a thermal expansion coefficient of the shaft;

wherein the fan wheel further comprises a fixing member and an outer ring part, the fixing member is disposed at an axis position of the outer ring part and is convexly formed from the outer ring part, and the shaft hole penetrates through the fixing member along an axis; the locking fastener is of a hollow cylindrical nail body, a nail head is arranged in one end of the locking fastener and a plurality of leaflets divided by a gap arranged in the other end of the locking fastener, and the nail head resists against one end of the fixing member; and a plurality of clamping grooves are formed in an end wall at one end of the fixing member, the other end of the locking fastener is provided with bent portions, and the other end of the fixing member away from the clamping grooves resists against one corresponding nail head and the bent portions are clamped in the clamping grooves.

* * * * *